United States Patent [19]

Durfee, Jr.

[11] Patent Number: 5,037,075

[45] **Date of Patent: * Aug. 6, 1991**

[54] QUICK LOCK IN PARALLEL AND ANGLE PLATE SYSEM FOR MACHINING VISE

[75] Inventor: David L. Durfee, Jr., Meadville, Pa.

[73] Assignee: Durfee, Susan, Meadville, Pa.

[ * ] Notice: The portion of the term of this patent subsequent to May 8, 2007 has been disclaimed.

[21] Appl. No.: 495,777

[22] Filed: Mar. 19, 1990

[51] Int. Cl.[5] ..... B25B 1/24

[52] U.S. Cl. ..... 269/282; 269/279; 269/281; 269/271; 269/280

[58] Field of Search ..... 269/271, 279–284, 269/275, 261, 262

[56] References Cited

U.S. PATENT DOCUMENTS

| | | | |
|---|---|---|---|
| 1,579,582 | 4/1926 | Voltz | 269/283 |
| 3,341,190 | 9/1967 | Adamson . | |
| 4,251,066 | 2/1981 | Bowling | 269/283 |
| 4,482,306 | 4/1986 | Sassenberg | 269/282 |

*Primary Examiner*—Judy J. Hartman

*Attorney, Agent, or Firm*—Oliff & Berridge

[57] ABSTRACT

A holding device or lock in a machining vise for positioning plates including parallels and angles wherein the positioning plate is provided with a cleat extending from the rear surface along the bottom edge thereof. The plates are held in place by spring loaded engaging members. A recess in the machining vise, complementary in shape to the cleat, may be provided.

15 Claims, 2 Drawing Sheets

QUICK LOCK IN PARALLEL AND ANGLE PLATE SYSEM FOR MACHINING VISE

CROSS REFERENCE TO PRIOR APPLICATION

This is a continuation of application Ser. No. 223,418, filed July 25, 1988, now U.S. Pat. No. 4,923,186which is a continuation-in-part of my U.S. patent application Ser. No. 941,747, filed Dec. 15, 1986 abandoned.

SHORT STATEMENT OF THE INVENTION

Parallels and angle plates used in machine vises are traditionally held in place by springs which are inconvenient to use and which become separated from the vise. Also, chips tend to work their way between the vise and the parallels or angle plates and the accuracy of the positioning of the workpiece in the vise is therefore disturbed. The particular parallel and angle plates disclosed herein are made of a single plate with parallel or angled surfaces and a cleat rearwardly extending from the plate at its bottom which may be received in a complementary shaped slot in the removable jaw of the vise. The plates are held in place by spring loaded detent pins.

BACKGROUND OF THE INVENTION

This invention relates to an improved lock in parallel and angle mechanism that permits the quick attachment and detachment of the parallel or angle mechanism.

There is a long felt need for a simple efficient and economical locking or holding device for holding parallels and angles securely in machine vises. The parallel and angle system according to the present invention includes a cleat that is received in a slot in a removable jaw of the machine vise. Spring loaded detents hold the cleat in place in a complementary shaped slot in the removable jaw of the vise.

It is an object of the invention to provide improved parallels and angle plates for use on a machine vise.

Another object of the invention is to provide a parallel and angle plate for a machine vise and means to hold the jaw in place which is simple in construction, economical to manufacture and simple and efficient to use. This will in turn make it more economical to make and accurate to perform machining operations on parts being held in the machine vise.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
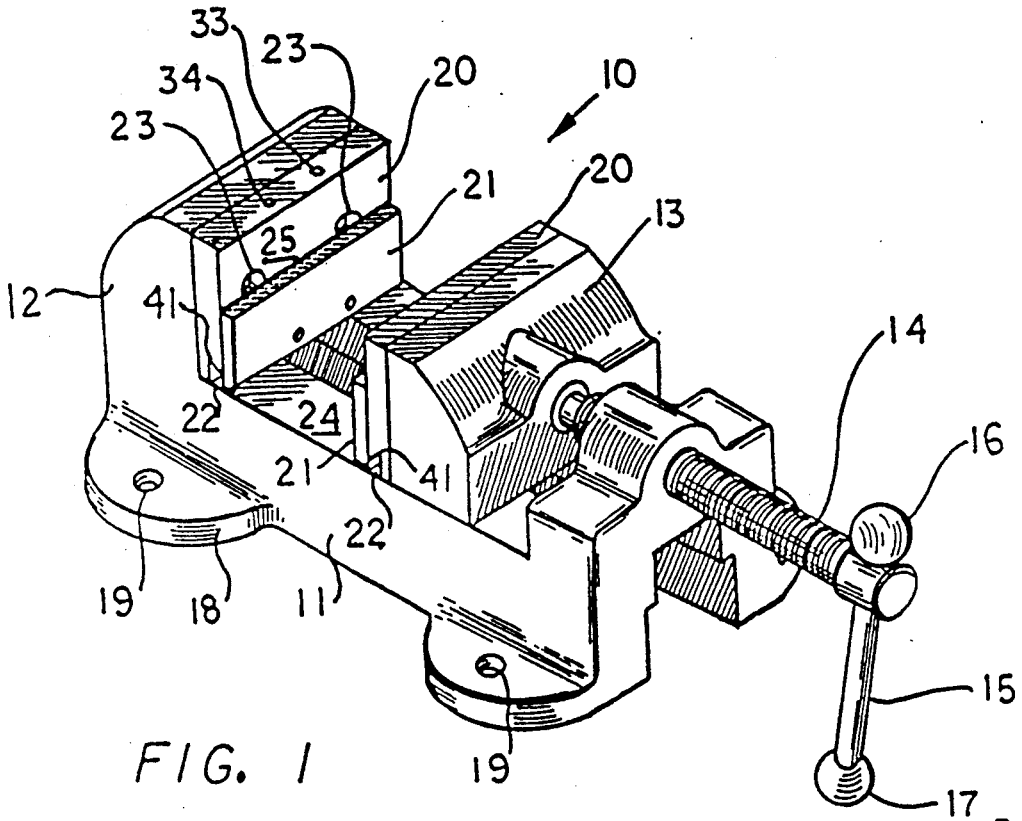
FIG. 1 is an isometric view of a machine vise with a parallel system on it according to the invention.

Now with more particular reference to the drawing, I show a machine vise 10 of conventional construction in FIG. 1 equipped with my improved jaw. The machine vise 10 has a base 11, a fixed jaw 12 fixed to base 11 and a movable jaw 13 slidably supported on base 1 and having a screw 14 threadably received in base 12 and engaging movable jaw 13 for moving it toward and away from fixed jaw 12. Base 11 has ears 18 integrally attached to it and extending outwardly from it. Ears 18 have bores 19 that receive screws for holding vise 10 to a milling machine table or the like. Handle 15 extends through screw 14 and has knobs 16 and 17 on its ends for rotating the screw and moving the movable jaw 13.

Removable jaw plates 20 are held to fixed jaw 11 and to movable jaw 13 in a conventional manner by means of screws 23 shown. Parallel plates 21 are held to fixed jaw 12 and to movable jaw 13 respectively by means of cleats 22, which are received in complementary shaped slots 41 at the lower edge of removable jaws 20. The top surface 24 of base 11 is flat. The bottom surface of movable jaw 13, as well as the bottom surface of parallel jaw 21, and cleat 22 slide over top surface 24 when the screw 14 is rotated by the handle 15.

Figure 3:
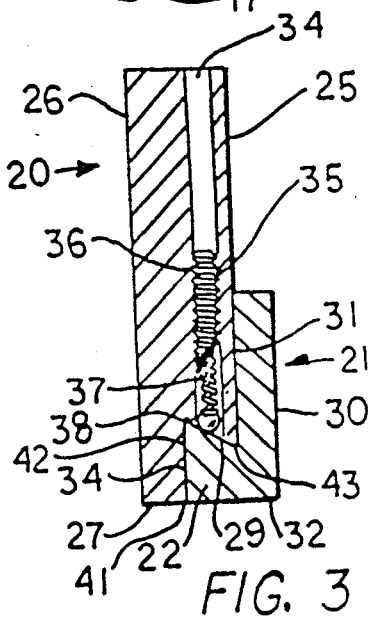
FIG. 3 is a longitudinal cross sectional view of the vise of FIG. 1.

As shown in FIG. 3, removable jaw plates 20 are in the form of rectangular shaped plates with a parallel front surface 25 which is parallel to rear surface 26 and both surfaces 25 and 26 are perpendicular to bottom surface 27. The slot 41 in the front surface 25 has a back surface 42 and a top surface 43 that inclines upwardly and toward back surface 42. Parallel jaw 21 has front surface 30 and rear surface 31 parallel to it which are both perpendicular to bottom surface 32. Cleat 22 has a flat bottom surface that is a continuation of bottom surface 32 of the parallel plate 21, a rear surface 28 and a top surface 29 that inclines downwardly and toward rear surface 31. Each cleat 22 is complementary in shape to the corresponding slot 41 in the lower edge of each removable jaw 20. Removable jaw 20 has two spaced bores 33 and 34 which are threaded at 35 and receive a threaded screw 36 that engages spring 37 and urges detent member 38 into engagement with the top surface 29 of cleat 22. Detent member 38 may be in the shape of a ball, as shown in the drawing, or it may be made in other configurations adapted to engage cleat 22. The tension on spring 37 may be increased by adjusting threaded screw 36.

Figure 4:
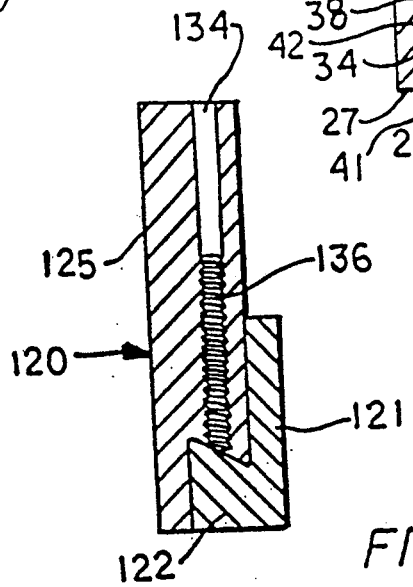
FIG. 4 is a cross sectional view similar to FIG. 3 showing a cross sectional view of the vise with a different parallel holding thereon.

The embodiment of the invention shown in FIG. 4 is similar to the one shown in FIG. 3, excepting parallel plate 121 has a cleat 122 on its lower end which is engaged by screws 136 themselves instead of a detent ball and the screws 136 are received in threaded bores 134 in removable jaw 120.

Figure 5:
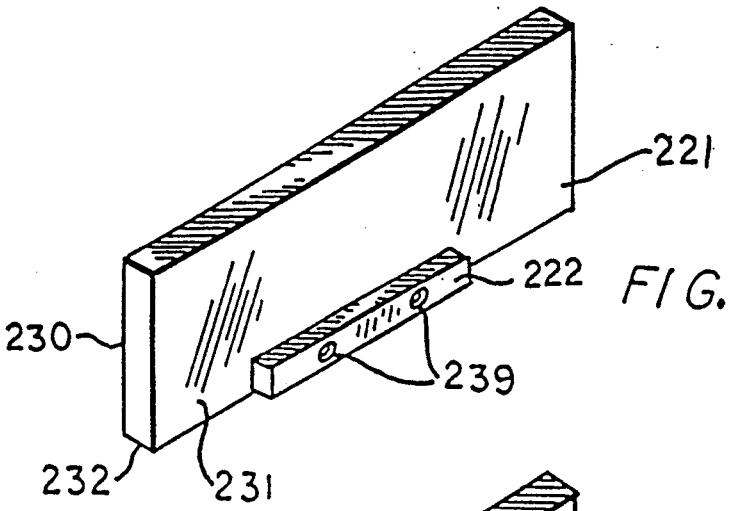
FIG. 5 is a isometric view of another embodiment of the parallel for a machine vise.

Parallel plate 221 shown in FIG. 5 has a front surface 230, a rear surface 231 and a bottom surface 232 and is similar in shape and configuration to parallel plates 21 shown in FIG. 3. However, cleat 222 is removable and threadably attached to parallel plates 221 by means of screws 239 which clamp cleat 222 to parallel plate 221. Cleat 222 will fit in a groove 41 of complementary shape in removable jaw plate 20 and is held in place by screws such as 33 and 34 as shown in the embodiment of FIG. 1.

Figure 2:
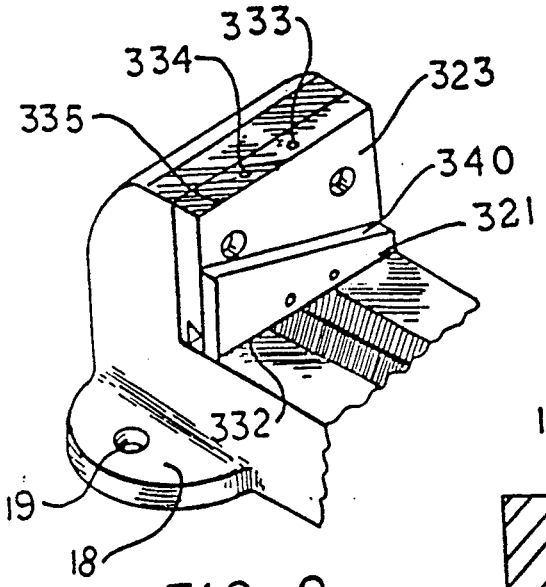
FIG. 2 a partial view of the vise and parallel system shown in FIG. 1 with a parallel having an inclined top according to the invention.

Angle plate 321 shown in the embodiment of the invention shown in FIG. 2 may have a cleat shaped like any of those shown in the embodiment of FIGS. 1 and 3 through 7 but its edge 340 is inclined relative to the bottom surface 32 of angle plate 321, thus allowing a piece being held in vise to be supported at a predetermined position. Depending on the angle desired, several angle plates with various top surface angles may be provided.

Figure 6:
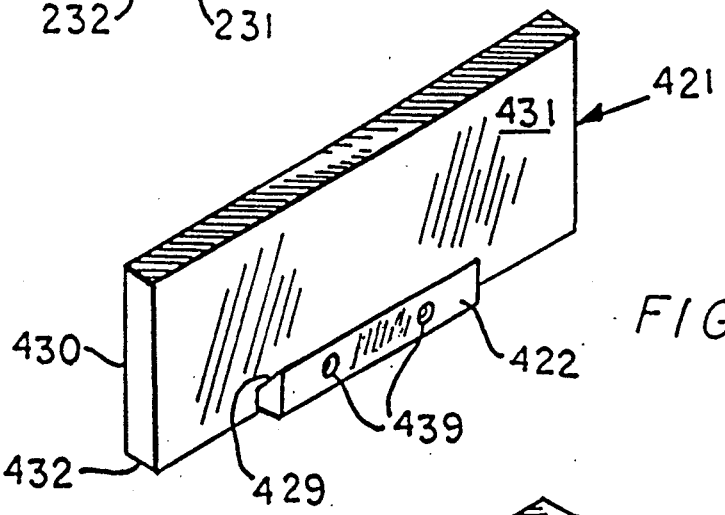
FIG. 6 is a isometric view of another form of cleat removably on the jaw; and, FIG. 7 is an isometric view of yet another form of the parallel cleat.

The embodiment of the invention shown in FIG. 6 has a cleat 422 fixed to the rear surface 431 of parallel plate 421. Parallel plate 421 has a front surface 430 and a bottom surface 432 similar to the other embodiments. The cleat 422 is attached to the parallel plate by screws 439 and has an inclined upper surface 429 similar to the top surface 29 shown in FIG. 3.

Figure 7:
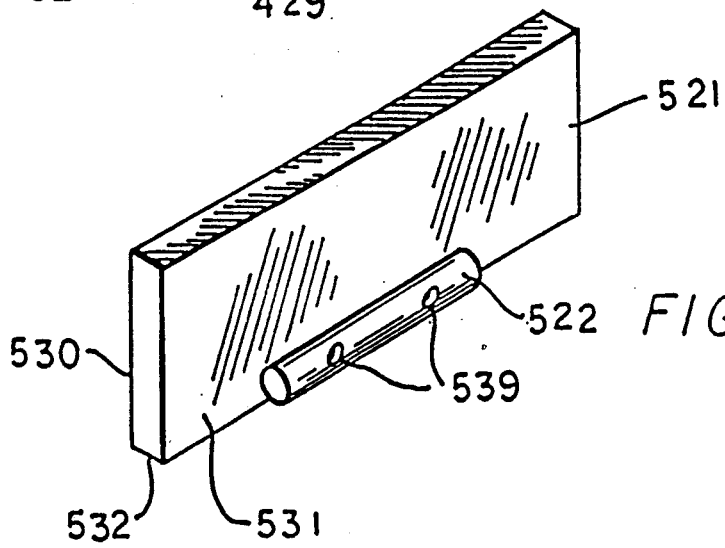

In the embodiment of the invention shown in FIG. 7, parallel plate 521 has a front surface 530, a rear surface 531, a bottom surface 532 and a cylindrical shaped cleat 522 held in place by screws 539. The removable jaw of the milling machine vise will have a slot at its bottom complementary in shape to cylindrical cleat 522. It may be shorter than the width of parallel plate 521.

Cleats may be attached to the parallel plates by screws or other means but also can be of one unit such as being cast complete as one unit or being machined out of one piece of metal as a complete unit as shown in FIG. 3.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A vise jaw system for a vise having a datum surface, the system comprising:

at least one removable jaw for selective attachment to said vise, said removable jaw having a bottom surface held in fixed relation to said datum surface and a front surface perpendicular to said datum surface, said removable jaw further including a recess formed in said one of the bottom and front surfaces of the removable jaw;

at least one positioning plate for selective attachment to said removable jaw, said positioning plate having a bottom face for contacting the datum surface and a rear face perpendicular to said datum surface;

said positioning plate further including a substantially horizontal cleat fixed to the positioning plate adjacent to the bottom face of the positioning plate, said cleat having a shape sized for reception of said cleat in said recess; and pressure said removable jaw including means including a portion being located between the removable jaw and the cleat for engaging said cleat when received in said recess to urge the bottom face of said positioning plate against said datum surface without movement of the positioning plate.

2. The system of claim 1 wherein the pressure means urges the rear face of the positioning plate against the front surface of the removable jaw.

3. The system of claim 1 wherein the pressure means includes at least one of a threaded member and a spring biased detent for engaging said cleat in the recess.

4. The system of claim 1 wherein the cleat of the positioning plate has an upper surface inclined relative to the bottom face of the positioning plate.

5. The system of claim 1 wherein the recess has a tapering cross-section, the size of the recess decreasing toward the front surface of the removable jaw.

6. The system of claim 1 wherein the cleat has a rectangular cross-section.

7. The system of claim 1 wherein the cleat has a square cross-section.

8. The system of claim 1 wherein the cleat includes a cylindrical surface.

9. The system of claim I wherein the positioning plate includes a top face parallel to the bottom face.

10. The system of claim 1 wherein the positioning plate includes a top face inclined at an acute angle relative to the bottom face.

11. The system of claim 1 wherein the cleat has an upper surface, and the pressure means is located in the removable jaw and contacts the upper surface of the cleat.

12. The system of claim 1 wherein the removable jaw includes two side surfaces contiguous to the bottom and front surfaces; a distance between the two side surfaces across one of the front and bottom surfaces defines a length of the removable jaw; and the recess extends for at least a portion of the length of the removable jaw.

13. The system of claim 11, wherein the shape of the cleat is complementary to a shape of the recess in the removable jaw.

14. The system of claim 1, wherein the cleat is fixed to the rear face of the positioning plate.

15. The system of claim 1, wherein the pressure means is located in the removable jaw.

* * * * *

UNITED STATES PATENT AND TRADEMARK OFFICE

CERTIFICATE OF CORRECTION

PATENT NO. : 5,037,075

DATED : August 6, 1991

INVENTOR(S) : David Durfee

It is certified that error appears in the above-identified patent and that said Letters Patent is hereby corrected as shown below:

Column 3, line 55
Claim 1, line 8, delete "one of the";
Column 4, line 10
Claim 1, line 19, delete "said removable jaw including".

Signed and Sealed this

Sixteenth Day of March, 1993

*Attest:*

STEPHEN G. KUNIN

*Attesting Officer*

*Acting Commissioner of Patents and Trademarks*